United States Patent [19]

Wilson

[11] 4,407,495

[45] Oct. 4, 1983

[54] MULTI-PURPOSE EXERCISE APPARATUS

[76] Inventor: Ronald A. Wilson, 1000 Strawberry La., Ashland, Oreg. 97520

[21] Appl. No.: 186,595

[22] Filed: Sep. 12, 1980

[51] Int. Cl.[3] ..... A63B 21/06

[52] U.S. Cl. ..... 272/117; 272/134; 272/DIG. 4

[58] Field of Search ..... 272/117, 123, 122, 134, 272/143, 144, 142, 130

[56] References Cited

U.S. PATENT DOCUMENTS

| | | | |
|---|---|---|---|
| 2,932,509 | 4/1960 | Zinkin | 272/117 |
| 3,414,261 | 12/1968 | Huebner | 272/117 |
| 3,558,131 | 1/1971 | Dragon | 272/134 |
| 3,690,655 | 9/1972 | Chapman | 272/94 |
| 3,850,430 | 11/1974 | Hamilton | 272/117 |
| 3,905,599 | 9/1975 | Mazman | 272/118 |
| 3,918,710 | 11/1975 | Niebojewski | 272/117 |
| 4,188,029 | 2/1980 | Brower | 272/62 |
| 4,226,414 | 10/1980 | Coffaro et al. | 272/117 |
| 4,231,568 | 11/1980 | Riley et al. | 272/134 X |

*Primary Examiner*—Richard C. Pinkham
*Assistant Examiner*—William R. Browne
*Attorney, Agent, or Firm*—Harvey B. Jacobson

[57] ABSTRACT

An elongated horizontal bench having first and second end portions is provided. An elevated support portion spaced horizontally outwardly of and above one end portion of the bench is supported from the latter and an elongated generally horizontal lever is pivotally supported intermediate its opposite ends from the support portion for oscillation about a horizontal axis transverse to the lever and the bench and with one end portion of the lever projecting toward and overlying the aforementioned one end portion of the bench. An elongated lever-type leg exercise frame is pivotally attached at one end to the other end portion of the bench for oscillation relative thereto about an axis transverse to the frame and the bench and the other end of the frame includes foot and/or leg engageable abutment structure. The aforementioned one end of the lever includes handgrip structure and weight structure is carried by the lever intermediate the handgrip structure and the first-mentioned axis. An elongated tension member extends between and is anchored to the other end of the leg exercise frame and the other end portion of the lever and the opposite end portions of the bench include low level tension member guide structure with which the mid-portion of the tension member is engaged and upwardly from which the opposite end portions of the tension member extend toward the leg exercise frame other end and the lever other end portion.

11 Claims, 6 Drawing Figures

MULTI-PURPOSE EXERCISE APPARATUS

BACKGROUND OF THE INVENTION

Various forms of exercise benches heretofore have been provided, but most previously known exercise benches may be utilized for only a few exercises. Accordingly, a need exists for an exercise bench constructed in a manner whereby a large number of exercises may be carried out in conjunction therewith.

Examples of previously known exercise benches and similar structures including some of the general structural and operational features of the instant invention are disclosed in U.S. Pat. Nos. 3,346,256, 3,558,131, 3,746,337, 3,905,599, 4,098,502 and 4,125,258.

BRIEF DESCRIPTION OF THE INVENTION

The exercise bench of the instant invention is constructed in a manner whereby various exercises may be accomplished in conjunction therewith. The various exercises which may be accomplished through utilization of the bench of the instant invention include regular bench presses, leg presses, military presses, front and back pull-downs, leg pull-downs and neck pulls and side arm pulls. Further, the bench may also be used as a conventional exercise board.

The main object of this invention is to provide an exercise bench with which a large number of exercises may be carried out.

Yet another object of this invention is to provide an exercise bench having a capacity of a large number of exercises and yet which is relatively simple in construction.

Still another object of this invention is to provide an exercise bench in accordance with the preceding objects and constructed in a manner whereby the bench occupies a limited plan area.

Still another important object of this invention is to provide an exercise bench including a large range of weight resistance capacity independent of adding or subtracting weights from the bench.

Another object of this invention is to provide an exercise bench constructed in a manner whereby a single weight change thereon may readily adapt the exercise bench for alternate use by a relatively strong male exerciser and a considerably less strong female exerciser.

A final object of this invention to be specifically enumerated herein is to provide an exercise bench in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
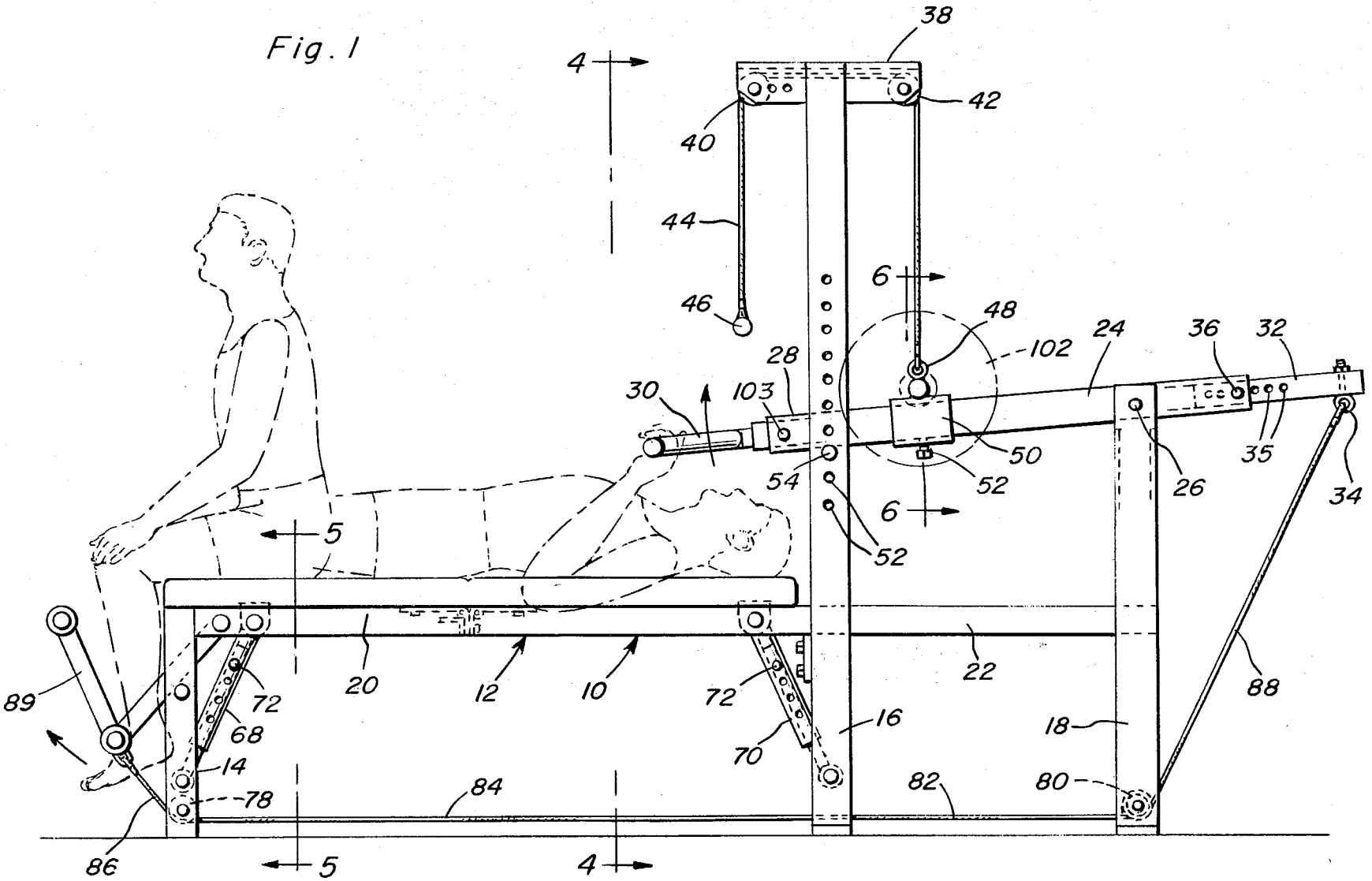
FIG. 1 is a side elevational view of the exercise bench of the instant invention with an exerciser illustrated in phantom lines in operative association therewith to perform two different exercises.
Figure 2:
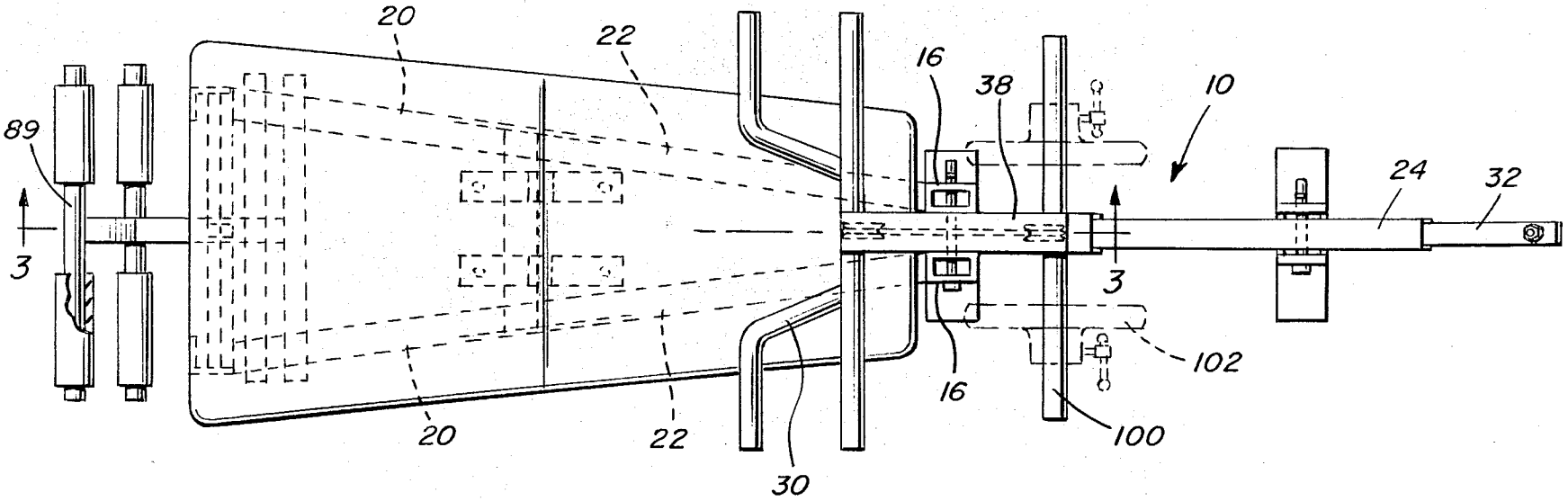
FIG. 2 is a top plan view of the exercise bench.
Figure 6:
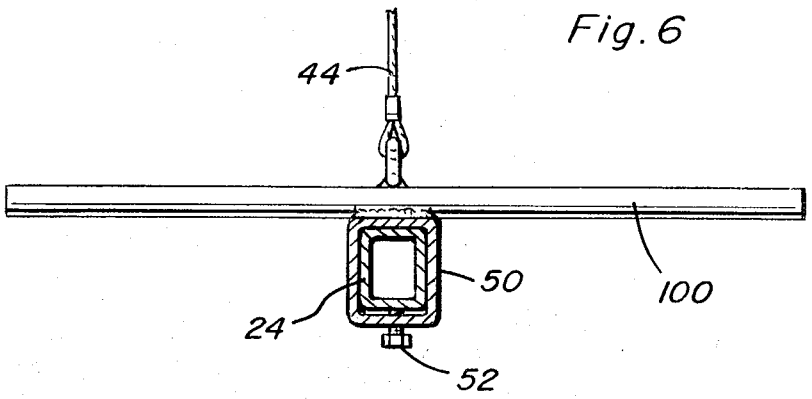
FIG. 6 is a fragmentary enlarged transverse vertical sectional view taken substantially upon the plane indicated by the section line 6—6 of FIG. 1.
Figure 5:
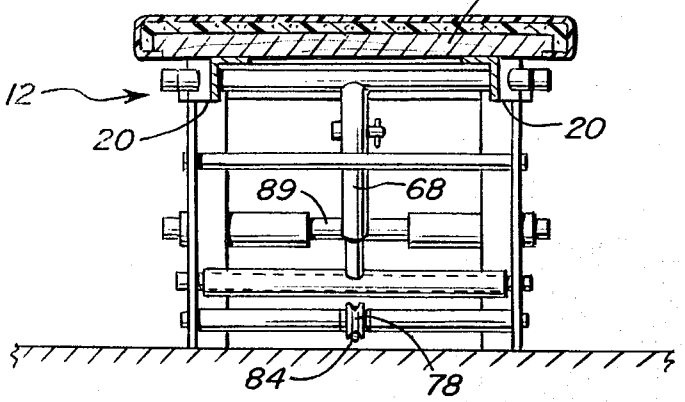
FIG. 5 is a fragmentary transverse vertical sectional view taken substantially upon the plane indicated by the section line 5—5 of FIG. 1.
Figure 4:
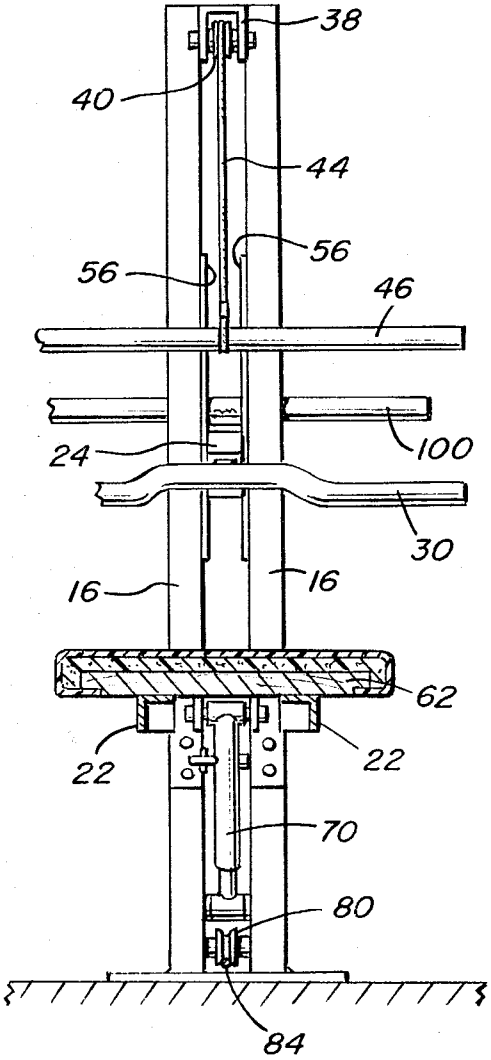
FIG. 4 is a fragmentary vertical sectional view taken substantially upon the plane indicated by the section line 4—4 of FIG. 1.

Referring now more specifically to the drawings, the numeral 10 generally designates the exercise bench of the instant invention. The bench 10 includes a main bench frame referred to in general by the reference numeral 12 including pairs of opposite side front, intermediate and rear uprights 14, 16 and 18. The opposite side uprights 14, 16 and 18 are closely spaced on opposite sides of the longitudinal center line of the frame 12 and the uprights 14 and 16 on corresponding sides of the frame 12 are interconnected through the utilization of horizontal angle members 20 extending therebetween and convergent toward the uprights 16. Similar but more closely spaced parallel angle members 22 extend between and interconnect the corresponding uprights 16 and 18 and are generally horizontally aligned with the angle members 20, the latter being horizontally aligned with the upper ends of the uprights 14.

An elongated lever or tube 24 is pivotally supported intermediate its opposite ends between the upper ends of the uprights 18 through the utilization of a pivot fastener 26. One end 28 of the lever 24 includes a longitudinally adjustable handgrip bar 30 supported therefrom and the other end of the lever tube 24 includes a longitudinally adjustable and endwise outwardly projecting anchor terminal end 32 from which an anchor eye 34 is supported. The terminal end 32 is provided with longitudinally spaced transverse bores 35 and the adjacent end of the lever tube 24 is provided with a removable cross pin 36 selectively engagable in a predetermined transverse bore 35 in order to vary the extension of the terminal end 32. The extendable handgrip bar 30 is extendable and releasably securable in adjusted extended position in the same manner.

The upper ends of the uprights 16 are interconnected by an inverted U-shaped channel member 38 extending longitudinally of the bench 10 and secured between the upper ends of the uprights 16. The opposite ends of the channel member 38 rotatably journal pulleys 40 and 42 over which an elongated flexible tension member 44 has its mid-portion trained. The end of the tension member 44 which extends downward from the forward pulley 40 has a transverse handgrip 46 supported therefrom and the end of the tension member 44 extending downwardly from the rear pulley 42 is anchored relative to an anchor eye 48 carried by a sleeve 50 adjustably slidable on the lever tube 24 between the uprights 16 and 18, the sleeve 50 being releasably securable in adjusted position through the utilization of a setscrew 52. Further, it is to be noted that the end 28 of the lever tube 24 is swingably received between those portions of the uprights 16 projecting above the angle members 20 and 22. In addition, the upper end portions of the uprights 16 include registered vertically spaced transverse bores 52 formed therethrough and a limit pin 54 is releasably securable through a selected pair of bores 52 for constituting a limit of movement of the end 28 of the lever tube 24 downwardly between the uprights 16. The vertical mid-portions of the uprights 16 includes bearing strips 56 supported therefrom for preventing direct contact between the lever tube 24 and the uprights 16.

Figure 3:
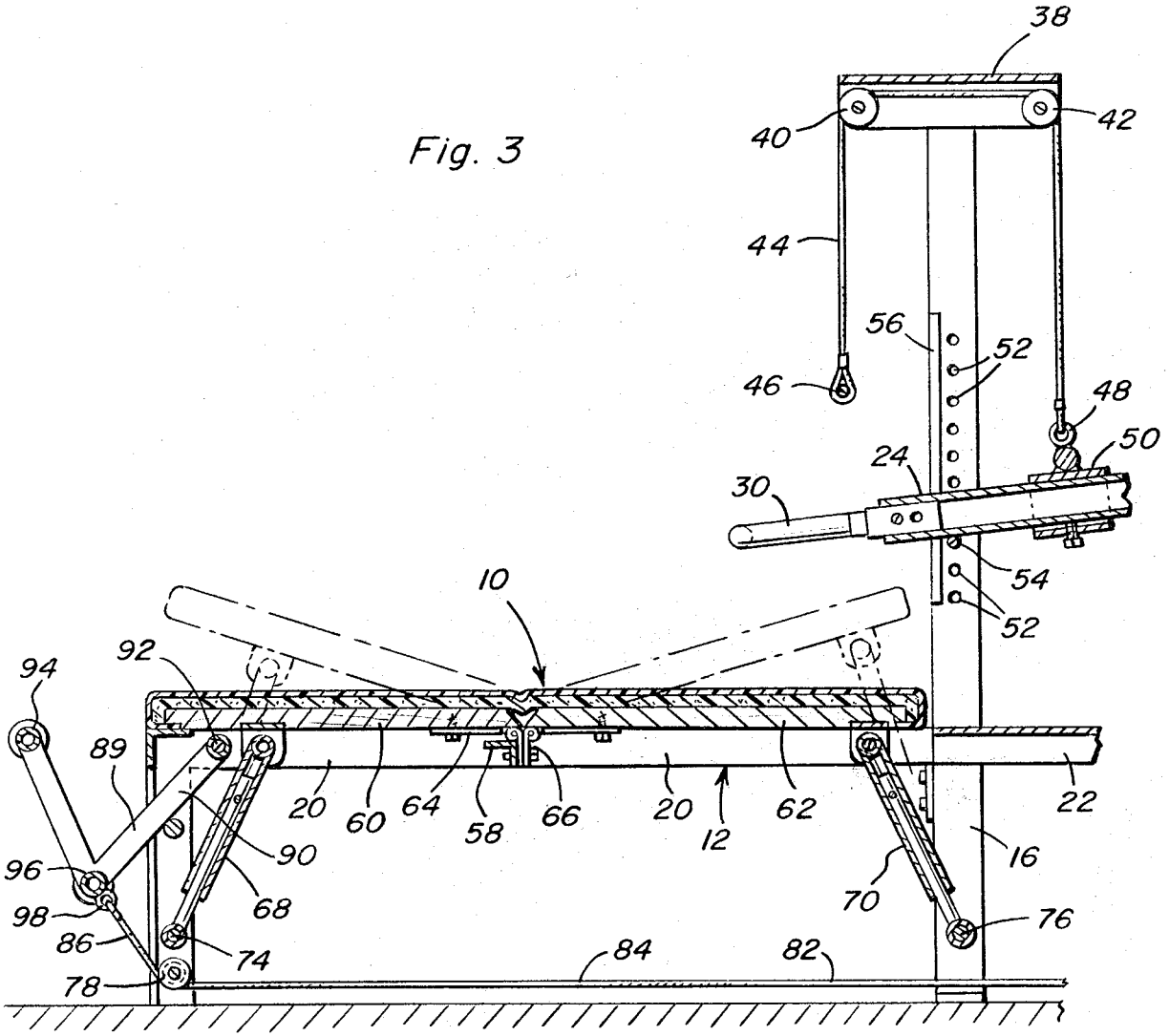
FIG. 3 is a fragmentary vertical sectional view taken substantially upon the plane indicated by the section line 3—3 of FIG. 2.

A transverse angle member 58 extends and is interconnected between the longitudinal mid-portions of the angle members 20 and a pair of end abutted bench seats 60 and 62 have their adjacent ends pivotally supported from the angle member 58 through the utilization of hinges 64 and 66. The bench seats 60 and 62 are swingable between the lowered horizontal positions overlying the angle members 20 illustrated in solid lines in FIG. 3 of the drawings and oppositely upwardly inclined positions such as those illustrated in phantom lines in FIG. 3. The vertically swingable ends of the bench seats 62 are equipped with depending pivotally supported and extendable props 68 and 70 and each of the props 68 and 70 includes a removable pin 72 by which the effective length of the corresponding prop may be adjusted. The lower end of the prop 68 is pivotally anchored to a crossbar 74 extending between the lower end portions of the uprights 14 and the lower end of the prop 70 is pivotally anchored to a crossbar 76 extending and connected between the lower ends of the uprights 16.

First and second pulleys 78 and 80 are journalled between the lower end portions of the uprights 14 and the uprights 18 and the pulleys 78 and 80 guidingly engage longitudinally spaced portions of the mid-portion 82 of an elongated flexible tension member 84 also including upwardly directed opposite end portions 86 and 88. The upper end of the end portion 88 is anchored relative to the eye 34 and an elongated foot frame 89 includes a first end portion 90 pivotally mounted between the forward ends of the angle members 20 as at 92 and a free vertically swingable end 94. In addition, the foot frame 88 includes a vertically swingable mid-portion 96 supporting an anchor eye 98 to which the end portion 86 of the tension member 84 is anchored. Accordingly, upward swinging of the free end of the foot frame 89 effects a downward pull on the terminal end 32 of the lever tube 24.

The sleeve 50 supports a horizontal crossbar 100 therefrom and any suitable forms of weights 102 may be mounted on opposite ends of the crossbar 100.

The pin 103 by which the handgrip bar 30 is removably and adjustably telescopically supported from the end 28 of the lever tube 24 may be removed in order to completely remove the handgrip bar 30. A person using the bench may then seat himself upon the upwardly swingable end of the bench seat 62 in order to complete front and back pull-downs. When an exerciser is lying down on his back in the manner illustrated in phantom lines in FIG. 1, regular bench presses may be made using the handgrip bar 30. If the exerciser reverses his position on the bench his feet may be engaged with the handgrip bar 30 and he may practice leg presses. In addition, when seated on the bench and facing the handgrip bar 30, the abutment pin 54 may be raised to a suitable level and the handgrip bar 30 may be used to effect military presses.

If the exerciser seats himself on the bench adjacent and facing the uprights 16, the exerciser may effect leg pull-downs and when the exerciser is laying on his back with his feet toward the weights 102, the bench seat 60 may be raised to a 45° angle and the handgrip 46 may be utilized to effect neck pulls and side arm pulls. Also, the bench, as illustrated in FIG. 1, may be utilized as an exercise board. Of course, when seated on the left hand end of the bench as seen in FIG. 1 of the drawings, the frame 89 may be engaged to effect various leg exercises.

It is also pointed out that various modifications of the abovementioned exercisers may be accomplished through the utilization of the bench 10. The amount of weight carried by the bar 100 may be varied according to the basic strength of a person to use the bench 10, but the amount of weight being exercised with may be varied according to the desires of the exerciser by adjustably positioning the slide or sleeve 50 along the lever tube 24 relative to said handgrip means. By sliding the sleeve 50 along the lever tube 24 and adjusting the extension of the terminal end 32, the effective weight represented by the weights 102 may be varied between approximately one-fifth the value of the weights 102 and two times the value of the weights 102. This of course provides the bench 10 with great versatility and enables a quick adjustment of the sleeve 50 to accomplish the desired weight load for various exercises to be performed, independent of actually removing weight from the bar 100 or adding weight thereto.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An exercise apparatus including a bench having first and second end portions, an elongated support portion spaced horizontally outwardly of and above said one end portion, an elongated generally horizontal lever pivotally supported intermediate its opposite ends from said support portion for oscillation about a horizontal axis transverse to said lever and said bench and with one end portion of said lever projecting toward and overlying said one end portion of said bench, an elongated levertype leg exercise frame pivotally attached at one end to the other end portion of said bench for oscillation relative thereto about an axis transverse to said frame and said bench, the other end of said frame including foot and/or leg engageable abutment means and said one end of said lever including handgrip means, weight means carried by said lever intermediate said handgrip means and the first-mentioned axis, and elongated tension member means extending between and anchored to said other end of said frame and the other end portion of said lever, the opposite end portions of said bench including low tension member guide means with which said tension member means is engaged and upwardly from which the opposite end portions of said tension member means extend toward said frame other end and said lever other end portion.

2. The combination of claim 1 including a carrier mounted on said lever between said lever handgrip means and the first-mentioned axis for adjustable positioning along said lever, said weight means being supported from said carrier.

3. The combination of claim 1 wherein said bench includes an elevated support disposed over said one end portion of said lever, said elevated support including tension member guide means, an elongated flexible tension member, said tension member including a mid-portion guidingly engaged with said last-mentioned guide means and including opposite depending end portions, one of said last-mentioned tension member end portions being anchored relative to said weight means and the other end portion of said last-mentioned tension member including handgrip means, said handgrip means carried by said lever being removably supported therefrom.

4. The combination of claim 1 wherein said other end portion of said lever is supported from the remainder of said lever for lengthwise extension and retraction relative thereto.

5. The combination of claim 1 wherein said bench includes a standard extending upwardly along said one end of said lever, said standard including vertically adjustable abutment means supported therefrom engageable by said one end of said lever to limit downward swinging of said lever one end.

6. The combination of claim 1 wherein said bench includes opposite end elongated support panels mounted thereon in end to end abutting relation with the adjacent ends of said support panels pivotally supported from said bench for angular displacement about horizontal transverse axes, means operatively connected between the remote ends of said support panels and said bench for securing said support panel remote ends in adjusted elevated positions relative to said bench.

7. An exercise apparatus including a bench having first and second end portions, an elevated support portion spaced horizontally outwardly of and above one end portion of said bench, an elongated generally horizontal lever pivotally supported intermediate its opposite ends from said support portion for oscillation about a horizontal axis transverse to said lever and said bench and with one end portion of said lever projecting toward and overlying said one end portion of said bench, said one end portion of said lever including handgrip means, weight means carried by said lever intermediate said handgrip means and said axis, said weight means being mounted on a follower, said follower being mounted on said lever for adjustable positioning therealong relative to said handgrip means, said bench including an elevated support disposed over said one end portion of said lever, said elevated support including tension member guide means supported therefrom, an elongated flexible tension member having a longitudinal mid-portion thereof guidingly engaged with said guide means and first and second depending opposite end portions one of said depending opposite end portions being anchored relative to said follower, the other of said depending end portions being providing with a handgrip, said handgrip means carried by said one end portion of said lever being removably supported therefrom.

8. The combination of claim 7 wherein said bench includes an upright standard, said elevated support being carried by an upper portion of said standard, said standard including upwardly facing abutment means supported therefrom and for adjustment vertically therealong below said elevated support, said one end of said lever being downwardly engageable with said abutment means to limit downward swinging of said one end of said lever.

9. The combination of claim 8 wherein said bench includes opposite end elongated support panels mounted thereon in end to end abutting relation with the adjacent ends of said support panels pivotally supported from said bench for angular displacement about horizontal transverse axes, means operatively connected between the remote ends of said support panels and said bench for securing said support panel remote ends in adjusted elevated positions relative to said bench.

10. An exercise apparatus including a bench having first and second end portions, an elevated support portion spaced horizontally outwardly of and above one end portion of said bench, an elongated generally horizontal lever having opposite end portions, one of said end portions of said lever being pivotally supported from said support portion for oscillation about a horizontal axis transverse to said lever and said bench and with the other end portion of said lever projecting toward and overlying said one end portion of said bench, a follower mounted on said lever for adjustable positioning therealong, weight means carried by said follower, said bench including an elevated support disposed over said other end portion of said lever, said elevated support including tension member guide means supported therefrom, an elongated flexible tension member having a longitudinal midportion thereof guidingly engaged with said guide means and first and second depending opposite end portions, one of said depending opposite end portions being anchored relative to said lever at a point spaced therealong from said axis, the other of said depending end portions being provided with a handgrip, and handgrip means removably supported from said other end portion of said lever.

11. An exercise apparatus including a bench having first and second end portions, an elevated support portion spaced horizontally outwardly of and above one end portion of said bench, an elongated generally horizontal lever having opposite end portions, one of said end portions of said lever being pivotally supported from said support portion for oscillation about a horizontal axis transverse to said lever and said bench and with the other end portion of said lever projecting toward and overlying said one end portion of said bench, weight means carried by said lever intermediate said axis and other end portion of said lever and said weight means being adjustably positioned along the length of said lever, said bench including an elevated support disposed over said other end portion of said lever, said elevated support including tension member guide means supported therefrom, an elongated flexible tension member having a longitudinal mid-portion thereof guidingly engaged with said guide means and first and second depending opposite end portions, one of said depending opposite end portions being anchored relative to said lever at a point spaced therealong from said axis, the other of said depending end portions being provided with a handgrip generally vertically registered with said other end portion of said lever and hand grip means removably supported from said other end portion of said lever.

* * * * *